US005970610A

United States Patent [19]

Yumikura et al.

[11] Patent Number: 5,970,610

[45] Date of Patent: Oct. 26, 1999

[54] STRUCTURE OF A CONTACT POINT OF A TERMINAL PIECE AND PRODUCTION METHOD THEREFOR

[75] Inventors: Yoshiharu Yumikura; Kiyohumi Mashikawa, both of Omiya, Japan

[73] Assignee: Kansei Corporation, Omiya, Japan

[21] Appl. No.: 08/818,900

[22] Filed: Mar. 17, 1997

[30] Foreign Application Priority Data

Mar. 15, 1996 [JP] Japan ..... 8-059245

[51] Int. Cl.[6] ..... H01R 43/16

[52] U.S. Cl. ..... 29/874; 29/876; 72/354.6

[58] Field of Search ..... 29/874, 882, 876

[56] References Cited

U.S. PATENT DOCUMENTS

| | | | |
|---|---|---|---|
| 2,358,745 | 9/1944 | Stieglitz | 29/874 |
| 2,610,390 | 9/1952 | Locke | 29/874 |
| 3,377,700 | 4/1968 | Cooley | 29/882 |
| 4,245,491 | 1/1981 | Kondo et al. | 72/325 X |
| 5,161,403 | 11/1992 | Kitchens | 29/882 X |

FOREIGN PATENT DOCUMENTS

| | | | |
|---|---|---|---|
| 3108502 | 9/1982 | Germany | 29/882 |
| 62-98125 | 6/1987 | Japan . | |
| 986575 | 1/1983 | U.S.S.R. | 72/354.6 |

*Primary Examiner*—Carl J. Arbes

*Attorney, Agent, or Firm*—Jacobson, Price, Holman & Stern, PLLC

[57] ABSTRACT

According to a production method for a structure of a contact point of a terminal piece, it is possible to heighten the durability of the terminal piece by thickening the contact point without raising material cost and processing costs. Materials for a copper plate (20) of a circumferential wall portion (18) of a contact point (16) are gathered and pressed toward substantially the center of a top portion (17). The materials are moved toward substantially the center of the top portion (17), so that the thickness of the top portion (17) becomes larger by a thickness of α than the thickness (T) of the copper plate (20). The top portion (17) is formed to be thicker than the circumferential wall portion (18).

5 Claims, 4 Drawing Sheets

STRUCTURE OF A CONTACT POINT OF A TERMINAL PIECE AND PRODUCTION METHOD THEREFOR

BACKGROUND OF THE INVENTION

1. Field of the Invention

This invention relates to a structure of a contact point of a terminal piece which is used principally for a switch, such as an ignition switch for a vehicle, and to a production method for the structure thereof.

2. Description of the Prior Art

There has been known a structure of a contact point of a terminal piece and a production method for the terminal piece, as shown in FIGS. 8 and 9 (see Japanese Laid-open Utility Model Publication No. Sho 62-98125).

In FIGS. 8 and 9, each of the terminal pieces 1 has a platelike leg portion 4 which is inserted into and connected to each of connector slits 3 of a corresponding connector 2.

The terminal piece 1 further has a base plate portion 5 extending from the leg portion 4. The base plate portion 5 has substantially the same thickness as that of the leg portion 4 and is formed integrally with the leg portion 4 by bending a single copper plate substantially perpendicularly.

The base plate portion 5 is brought into contact with or separated from a contact point plate 10 on a movable side which functions as another terminal contact point, so that an electric signal is passed or shut off electrically.

By pressing, the base plate portion 5 is provided with a contact point 6 shaped substantially into a hat in section which expands in a direction in which the leg portion 4 extends, in other words, expands toward the movable-side contact point plate 10.

The contact point 6 has a top portion 7, which can come into contact with the movable-side contact point plate 10, and a circumferential wall portion 8 formed around the top portion 7.

The thus formed terminal pieces 1 are buried and fixed in an insulating bass 9 by, for example, insert forming.

The movable-side contact point plate 10 is attached to a rotor 12 disposed rotatably in a cylindrical case 11.

The rotor 12 is rotated along with an ignition key (not shown), and thereby movable contact points 13, 13 attached to the movable-side contact point plate 10 are brought into contact with or separated from the top portions 7, 7 of the contact points 6, 6, respectively. Accordingly, various modes of positionings, such as turn-on, turn-off, starting, or electrical continuity in accessories, are performed.

However, in this conventional structure of the contact point of the terminal piece and the production method for it, the top portion 7 of the contact point 6 is spread out when being formed by pressing.

Therefore, there is a fear that the top portion 7 will be formed thinner than the base plate portion 5 therearound and accordingly abrasion caused by a repetition of the contact and separation of the top portion 7 with and from the movable contact point 13 will lower the durability of the top portion 7.

In order to solve this problem, it might be a possible solution to heighten the durability of the top portion 7 by increasing the thickness of the base plate 5 and the leg portion 4 approximately 2 to 2.5 times.

However, this method brings about a rise in material cost for increasing the thickness of a copper plate used as metallic materials and a rise in processing costs for bending the leg portion 4 and the base plate 5 or forming the leg portion 4 so as to be inserted into the connector slit 3 of the connector 2.

SUMMARY OF THE INVENTION

It is an object of the present invention to provide a structure of a contact point of a terminal piece and a method of producing it, according to which durability can be heightened by enlarging the thickness of a contact point without raising material cost and processing costs.

In order to solve the aforementioned problem, a structure of a contact point of a terminal piece according to the present invention comprises a platelike leg portion which is inserted into and connected to a connector slit, and a base plate portion extending from the leg portion. The base plate portion transmits an electric signal to another terminal contact point which comes into contact with the base plate portion, and has substantially the same thickness as that of the leg portion. The base plate portion is swelled toward the terminal contact point so as to have a top portion which can come into contact with the terminal contact point and a circumferential wall portion which is formed around the top portion and, as a result, have a contact point, which is made of metal, with a substantially hat-shaped section. By pressing, the top portion is formed such that the metallic material of the circumferential wall portion is concentrated on substantially the center of the top portion.

In the thus constructed structure, the metallic material of the circumferential wall portion is concentrated on substantially the center of the top portion and pressing is performed. Accordingly, the metallic material of the circumferential wall portion is moved toward substantially the center of the top portion, so that the thickness of the top portion is enlarged. As a result, the durability against the abrasion caused by contact or separation of the contact points can be heightened.

Further, in the structure, the thickness of the top portion is designed to become larger than that of the circumferential wall portion.

Since the thickness of the top portion constructed as mentioned above is formed to become larger than that of the circumferential wall portion, the thickness of the top portion, which undergoes the abrasion to a largest extent, is enlarged so that the durability can be heightened, even though the same metallic material is used.

Further, in the structure, the thickness of the top portion is designed to become equal to or larger than that of the base plate portion except the top portion.

Therefore, all that has to be done is to enlarge the thickness of the top portion to an extent where the durability can be retained. Consequently, a rise in material cost can be prevented, and a bending process or a process of shaping the terminal piece so as to applicable to other connectors can be performed easily because the base plate portion and the leg portion have no need to be thickened.

A method of producing a terminal piece according to the present invention is characterized in that platelike metallic material of which the base plate portion is made is placed on a platelike die, and pressing is performed by using a punch having a conical pressing side such that the circumferential part of the metallic material is concentrated on the center of the metallic material.

Therefore, the circumferential part of the metallic material is concentrated on the center thereof, so that the thickness of the contact point can be enlarged.

As a consequence, the thickness of the contact point becomes larger than that of the circumferential part, and thus the durability can be heightened.

A method of producing a terminal piece according to another aspect of the present invention is characterized in that metallic material is placed on a die having a concave portion and then is pressed by a punch such that the metallic material around the concave portion is plunged into the concave portion while being concentrated.

Accordingly, the plunged metallic material therearound contributes to enlarging the thickness of the contact point. Thereby, the thickness of the contact point becomes larger than that of the part therearound, and thus the durability can be heightened.

A method of producing a terminal piece according to still another aspect of the present invention is characterized in that platelike metallic material of which the base plate portion is made is placed on a platelike primary die, and primary pressing is performed by a primary punch having a conical pressing side such that the circumferential part of the metallic material is concentrated on the center thereof, and in addition, the metallic material which has undergone the primary pressing is placed on a secondary die having a concave portion into which the concentrated metallic material part is plunged, and secondary pressing is performed by a secondary punch such that the concentrated metallic material part is pressed toward the concave portion.

Since the metallic material is concentrated on the top portion in the primary pressing and thereafter is plunged into the concave portion in the secondary pressing, there is less fear of damaging the metallic material, and the thickness of the top portion can be enlarged.

A method of producing a terminal piece according to still another aspect of the present invention is characterized in that the metallic material which has been plunged into the concave portion of the secondary die in the secondary pressing is engaged with and is placed on a concave portion formed in a tertiary die, and tertiary pressing is performed by a tertiary punch such that the metallic material part placed on the concave portion is pressed out and is spread toward the concave portion, and thus the cylindrical circumferential wall portion having a predetermined height is formed around the top portion.

The diameter of the concave portion is formed to become smaller than that of the punch for dropping metallic material into the concave portion.

Therefore, since the metallic material plunged into the concave portion increases by the volume of the metallic material pressed by the punch, the height from the end of the punch to the end of the top portion can be made larger than the thickness of the metallic material.

Accordingly, the thickness of the top portion can be designed to become larger than that of the metallic material except the top portion.

A method of producing a terminal piece according to still another aspect of the present invention is characterized in that pressing is performed onto the metallic material plunged into the concave portion, and the circumferential wall portion is formed such that the top portion juts out of a resinous base member when being inserted into the resinous base member.

In the structure constructed according to this method, the circumferential wall portion of the metallic material plunged into the concave portion is formed by the pressing such that the top portion has a configuration to be revealed out of the resinous base when the insertion into the resinous base member is performed.

Therefore, the insertion thereinto is performed easily.

DETAILED DESCRIPTION OF THE EMBODIMENT

Figure 1:
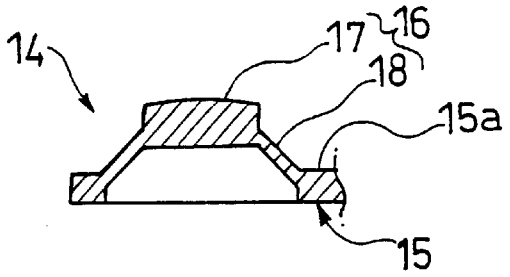
FIG. 1 is a sectional view of a structure of a contact point of a terminal piece according to a first embodiment of the present invention, showing a main part taken along line A—A of FIG. 2.
Figure 2:
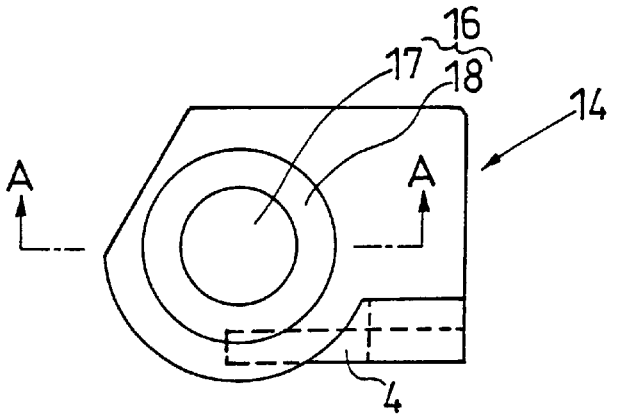
FIG. 2 is a top view of the terminal piece according to the first embodiment of the present invention.
Figure 3:
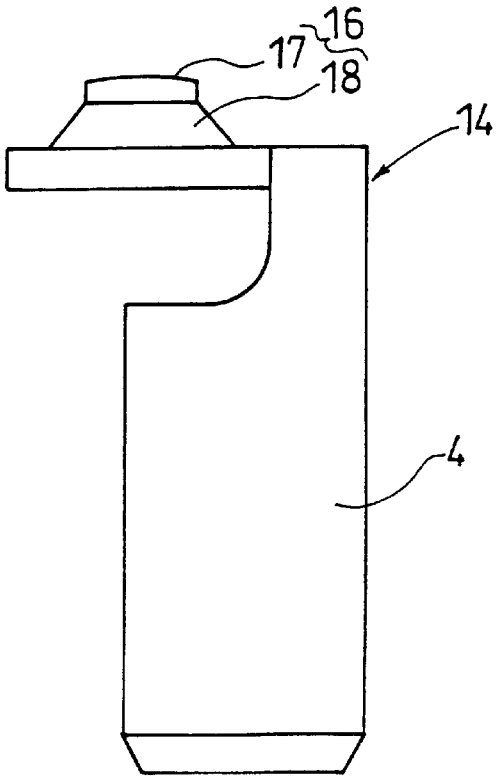
FIG. 3 is a side view of the terminal piece according to the first embodiment of the present invention.
Figure 4:
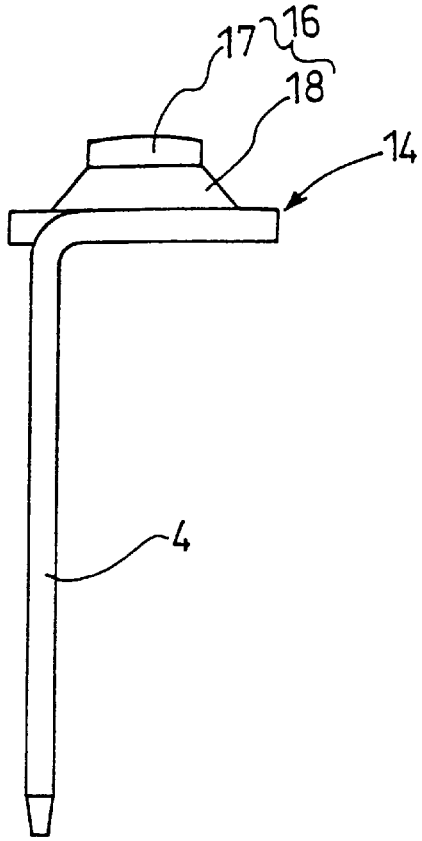
FIG. 4 is a front view of the terminal piece according to the first embodiment of the present invention.

An embodiment of a structure of a contact point of a terminal piece according to the present invention will be hereinafter described in detail with reference to the accompanying drawings.

FIGS. 1 to 7 show a first embodiment of the present invention. In this embodiment, the same reference characters are given to the same or equivalent component parts as those of the conventional structure.

First, a construction thereof will be explained. In FIG. 1, reference character 14 designates a terminal piece of the first embodiment. The terminal piece 14 has a platelike leg portion 4 (see FIGS. 2 and 3) which is inserted into and connected to each of connector slits of another connector.

The terminal piece 1 also has a base plate portion 15 extending from the leg portion 4. The base plate portion 15 has substantially the same thickness as that of the leg portion 4 and is formed integrally by bending a single copper plate 20 (see FIGS. 5 to 7) substantially perpendicularly to the leg portion 4.

The base plate portion 15 comes into contact with or moves away from a contact point plate 10 on a movable side which functions as another terminal contact point, and transmits or shuts off an electric signal electrically.

The base plate portion 15 is swelled toward the movable-side contact point plate 10 by pressing, and thereby a contact point 16 having a substantially hat-shaped section is formed in the base plate portion 15.

The contact point 16 has a substantially dish-shaped top portion 17 having a curved-line convex configuration suitable for the contact with each of movable contact points 13 of the movable-side contact point plate 10 or separation therefrom, and a circumferential wall portion 18 formed around the top portion 17.

In the first embodiment, the thickness of the top portion 17 is designed to be larger than that of the circumferential wall portion 18, and in addition, the thickness of the top portion 17 is designed to be larger than that of the base plate portion 15.

A method of producing the terminal piece according to the first embodiment will be described with reference to the FIGS. 5 to 7.

The base plate portion 15 of the terminal piece 14 is formed in such a way that a copper plate 20 as metallic material is placed on a platelike die or the like, and thereafter pressing is performed three times so that the material of the circumferential copper plate 20 is concentrated on the center thereof by a punch 21 having a conical pressing side.

Figure 5:
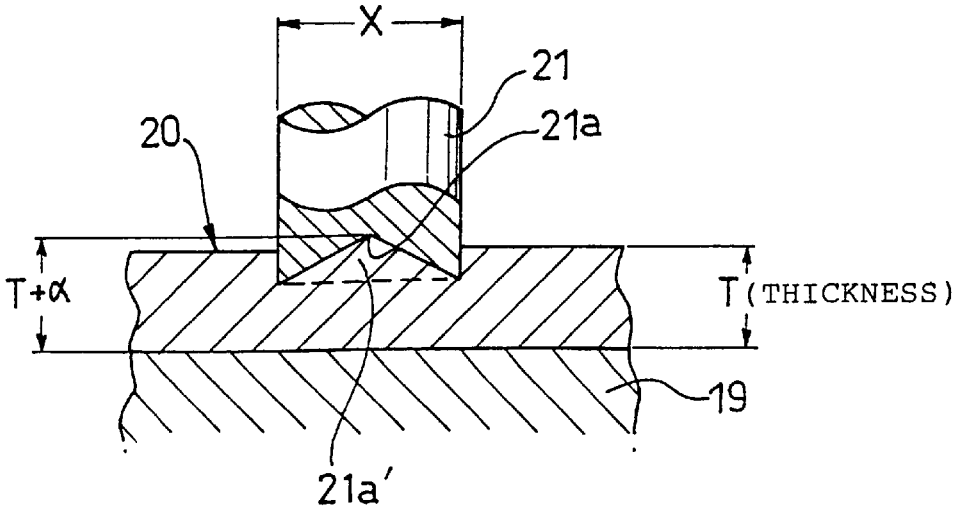
FIG. 5 is a partially sectional view of a main part of the structure when performing first pressing, explaining a method of producing the terminal piece according to the first embodiment of the present invention.

First, as shown in FIG. 5, the platelike copper plate 20 of which the base plate portion 15 is made is placed on a platelike first die 19, and primary pressing is performed by a primary punch 21 having a conical pressing side, so that that the circumferential part of the metallic material is concentrated on the center thereof.

The primary punch 21 has a substantially cylindrical shape with a measure X in the diametrical direction, and a pressing side thereof on the under surface side of the figure has a conical shape with a predetermined depth as far as a top portion 21*a* formed at the central position.

The pressing is performed by the primary punch 21 having the conical pressing side, such that the circumferential part of the copper plate 20 is concentrated on the top portion 21*a* in the center thereof, and thereby a part 21*a*' is formed. The distance from the under surface of the copper plate 20 to the top portion 21*a* grows longer by an increase $\alpha$ in thickness formed with the material concentrated by the primary pressing than the thickness T of the copper plate 20.

Figure 6:
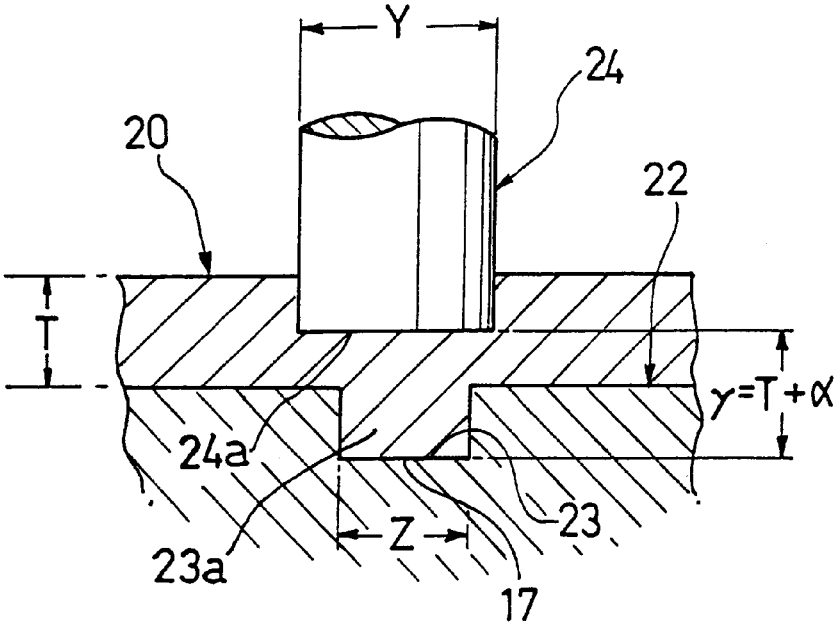
FIG. 6 is a partially sectional view of a main part of the structure when performing second pressing, explaining a method of producing the terminal piece according to the first embodiment of the present invention.

Next, as shown in FIG. 6, the part 21*a*' concentrated from the copper plate 20 is moved to and placed on a concave portion 23 formed in a secondary die 22 correspondingly to the concave portion 23, and thereafter secondary pressing is performed.

The concave portion 23 is formed to have a diameter Z smaller than the measure X in the diametrical direction of the primary punch 21 such that the part 21*a*' concentrated from the copper plate 20 is Plunged into the concave portion 23.

The copper plate 20 formed by the primary pressing is placed on the secondary die 22, and then the part 21*a*' concentrated from the copper plate 20 is pressed from the upper part of FIG. 6 toward the concave portion 23 by means of a secondary punch 24.

The secondary punch 24 has a substantially cylindrical shape with a measure Y in the diametrical direction, which is the same measure as the measure X in the diametrical direction of the primary punch 21, and a pressing side 24*a* thereof on the under surface side of FIG. 6 is planar.

In the secondary pressing, the copper plate 20 is placed on the secondary die 22 having the concave portion 23, and then is pressed by the secondary punch 24. Thereby, the material of the copper plate 20 around the concave portion 23 is plunged into the concave portion 23 while being concentrated, so that a part 23*a* is formed.

The material of the copper plate 20 therearound which has been plunged contributes to enlarging the thickness of the contact point. Thereby, the thickness of the contact point becomes larger than that of the part therearound. In the first embodiment, the distance from the front end of the plunged copper plate 20 to the upper end, in FIG. 6, of the copper plate 20 pressed by the pressing side 24*a* becomes longer by an increase $\alpha$ in thickness formed with the material of the copper plate 20 which has been concentrated and plunged than the thickness T.

Figure 7:
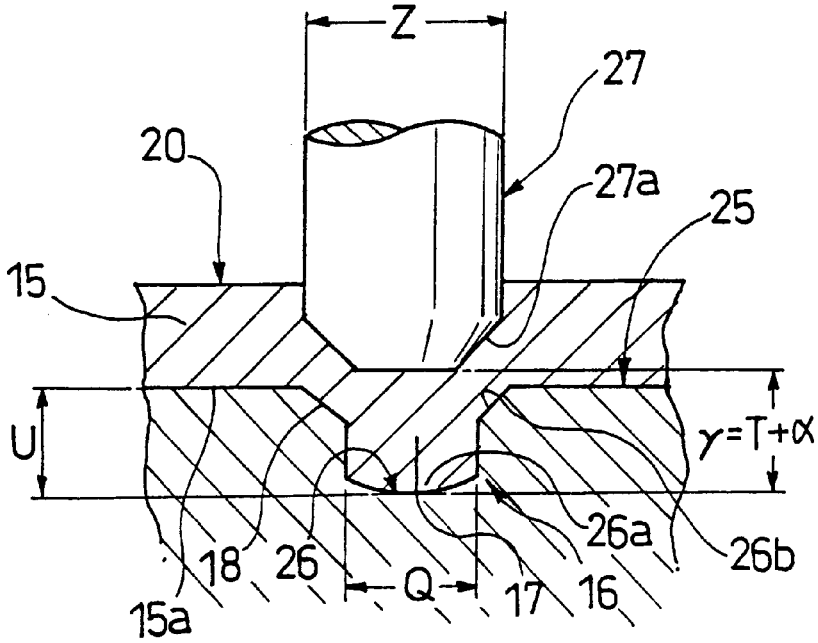
FIG. 7 is a partially sectional view of a main part of the structure when performing third pressing, explaining a method of producing the terminal piece according to the first embodiment of the present invention.
Figure 8:
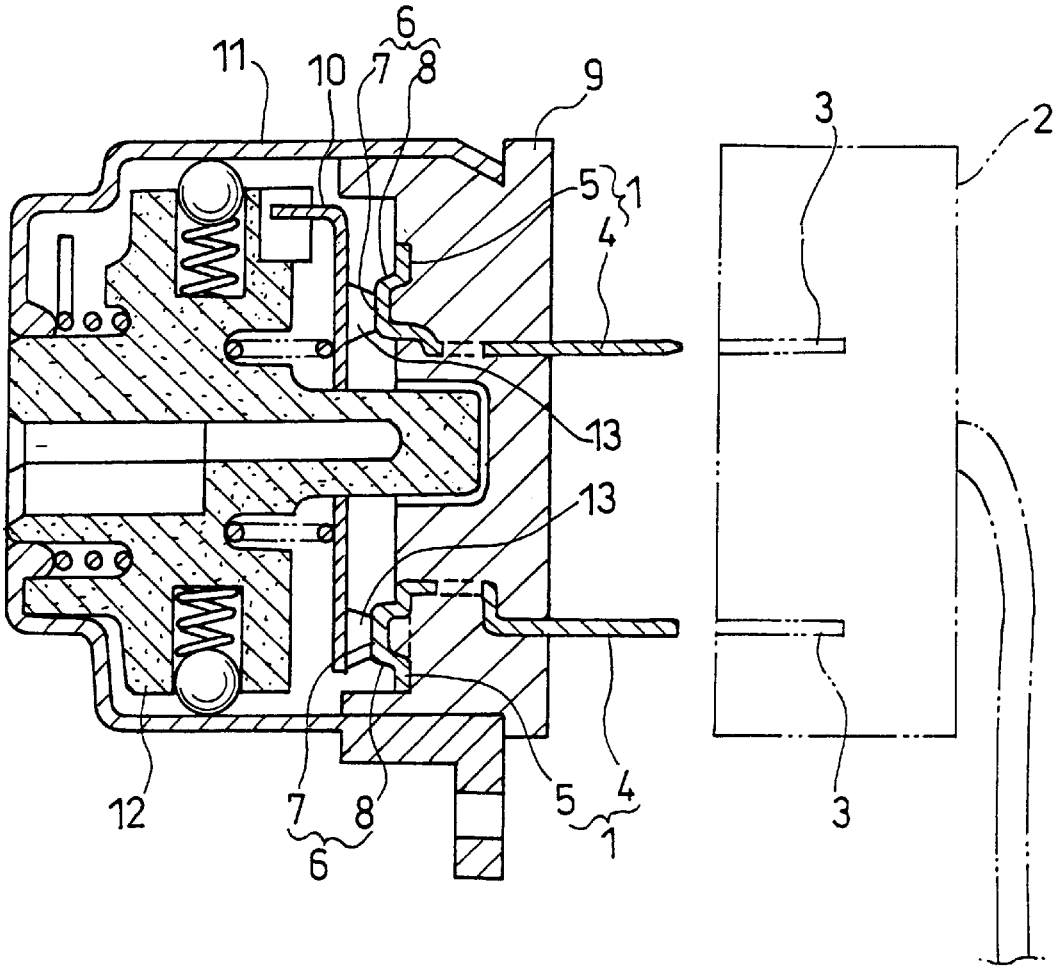
FIG. 8 PRIOR ART
FIG. 8 is a sectional view of an ignition switch for a vehicle in which a conventional terminal piece is used.
Figure 9:
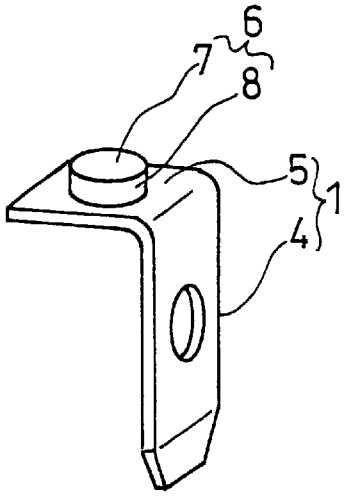
FIG. 9 PRIOR ART
FIG. 9 is a perspective view of the conventional terminal piece.

Next, as shown in FIG. 7, the copper plate 20 which has undergone the secondary pressing is displaced onto a tertiary die 25, and then a tertiary pressing is performed.

In other words, the part 23*a* of the copper plate 20 which has been plunged into the concave portion 23 in the secondary pressing is engaged with a concave portion 26 formed in the tertiary die 25 and is placed in the tertiary die 25.

In the concave portion 26, a measure Q in the diametrical direction thereof is made equal to the diameter Z of the concave portion 23, and in addition, a bottom portion 26*a* has a configuration with a predetermined curved surface where the curved surface of the top portion 17 of the contact point 16 is formed.

On the fringe of the concave portion 26, a circumferential wall forming portion 26*b*, where the circumferential wall portion 18 is formed, is formed circularly at a predetermined angle.

A tertiary punch 27 is used in the tertiary pressing. The tertiary punch 27 has a substantially cylindrical shape, and the measure Z thereof in the diametrical direction is made equal to the measure X of the primary punch 21 and the measure Y of the secondary punch 24 in the diametrical direction. In the circumferential end part of the tertiary punch 27, used as a press surface, on the under surface side in FIG. 7, there is formed a chamfered portion 27*a* having a predetermined angle where the circumferential wall portion 18 is formed.

In the tertiary pressing, therefore, the top portion 17 of the contact point 16 is shaped into a configuration having a curved surface suitable for the contact with another contact point terminal or separation therefrom, and the circumferential wall portion 18 is pressed and spread at a predetermined angle, so that the top portion 17 is revealed from the insulating base member 9 and is shaped into a configuration having a predetermined height U from the upper surface 15*a* of the base plate portion 15 when the insertion of the circumferential wall portion 18 into the insulating base member 9 used as a resinous base member, or the like, is performed.

Next, there will be described the function of the terminal piece according to the first embodiment.

In the contact-point structure of the terminal piece 14 according to the first embodiments since the pressing is performed such that the material of the copper plate 20 of the circumferential wall portion 18 of the contact point portion 16 is concentrated on substantially the center of the top portion 17, the material of the copper plate 20 of the circumferential wall portion 18 is moved toward substantially the center of the top portion 17, and thus the thickness of the top portion 17 which has undergone the pressing becomes larger by an increase $\alpha$ than the thickness T of the copper plate 20. As a result, the durability against the abrasion caused by contact and separation between the contact point portion 16 and the movable contact point 13 can be heightened.

Since the material of the copper plate 20 is plunged into the concave portion 23 in the secondary pressing after having been concentrated on the top portion 17 in the primary pressing, the pressing processes, in each of which the material of the copper plate 20 is spread in a different direction, are each conducted separately. Consequently, there is less fear that the material of the copper plate 20 will suffer damage, such as a crack, and the thickness of the top portion 17 can be enlarged.

Further, the primary pressing and the secondary pressing shown in FIGS. 5 and 6 may be performed simultaneously such that the copper plate 20 is placed on a die having the concave portion 23 and then the copper plate 20 around the concave portion 23 is pressed and plunged into the concave portion 23 while being concentrated by the punch.

In this way, the copper plate 20 is placed on the die 22 having the concave portion 23 and is pressed by the punch 21, and thereby the copper plate 20 around the concave portion 23 is plunged into the concave portion 23 while being concentrated.

The copper plate 20 therearound which has been plunged contributes to enlarging the thickness of the top portion 17 used as a contact point, and thereby the thickness of the contact point becomes larger than that of the part around the contact point, so that the durability can be heightened.

The diameter of the concave portion 23 is formed to be smaller than that of the secondary punch 24 by which the material of the copper plate 20 is plunged into the concave portion 23.

As shown in FIG. 6, therefore, since the metallic material plunged into the concave portion 23 increases by the volume of a part of the material of the copper plate 20 lying in a part of the secondary punch 24 whose diameter is larger than the diameter of the concave portion 23, the height $\gamma$ from the front end 24*a* of the secondary punch 24 to the top and of the top portion 17 can be made larger by the thickness $\alpha$ than the thickness T of the metallic material, that is, there can be obtained the relation $\gamma=T+\alpha$.

Accordingly, the thickness of the top portion 17 can be designed effectively to be larger than the thickness T of the material of the copper plate 20, and thus the durability of the contact point portion 16 can be heightened even more.

Further, as shown in FIG. 7, since the thickness of the top portion 17 is formed to be larger than that of the circumferential wall portion 18, the thickness of the top portion 17 which suffers the greatest abrasion, which is caused by the contact or separation between the contact points 16 and the movable contact points 13, in comparison with the other contact points is enlarged so that the durability can be heightened, even though the same material of the copper plate 20 is used.

Additionally, the tertiary pressing is conducted such that the top portion 17 has a configuration of being revealed from a surface of the insulating base 9 and thus has the predetermined height U, when the circumferential wall portion 18 of the material of the copper plate 20 which has been plunged into the concave portion 26 is inserted into the insulating base 9 used as the resinous base member.

In the primary and secondary pressing, the part around the concave portion 26 of the material of the copper plate 20 moves toward the center Thereby, in the tertiary pressing, the volume of a part of the material of the copper plate 20 which is held and spread between the circumferential wall forming portion 26*b* and the chamfered portion 27*a* is small, and the circumferential wall portion 18 is formed relatively easily to have the predetermined height U.

Therefore, the insertion into the insulating base 9 or the like is conducted easily.

As mentioned above, it is required only to enlarge the thickness of the top portion 17 to an extent where the durability can be retained. Consequently, a rise in material cost can be prevented, and a bending process for bending the base plate portion 15 perpendicularly to the leg portion 4, or a process for obtaining a configuration adapted for each of the connector slits 3 of the another connector 2 or the like can be conducted easily because the base plate portion 15 and the leg portion 4 can be prevented from being thickened.

With reference to the accompanying drawings, the first embodiment of the present invention was described as above. However, the present invention is not limited to the first embodiment. Any changes in design or the like without departing from the scope of the present invention are included in the present invention.

In the first embodiment, for example, the copper plate 20 is used as metallic material. However, the present invention is not limited to this. For example, another electric conductor, such as gold, silver or the like, may be used as a matter of course.

Further, in the first embodiment, the circumferential wall portion 18 has a predetermined angle. Instead, use may be made of a circumferential wall perpendicular to the upper surface of the base plate portion 15.

Further, in the first embodiment, the thickness of the top portion 17 is formed to become larger than that of the base plate portion 15 except the top portion 17. Instead, the two portions may have the same thickness if the thickness is large enough to heighten the durability.

What is claimed is:

1. A method of producing a terminal piece, said method comprising the steps of:

placing plate-shaped metallic material of which a base plate portion is placed upon a planar die; and performing pressing by the use of a punch having a conically recessed pressing side, said pressing being performed in such a way as to gather a circumferential part of said plate-shaped metallic material at a center of said plate-shaped metallic material.

2. A Method of producing a terminal piece, said method comprising the steps of:

placing metallic material upon a die having a concave portion; and pressing said metallic material with a punch in such a way as to gather and plunge a metallic material part around said concave portion into said concave portion, said concave portion being formed to be smaller in diameter than said punch.

3. A method of producing a terminal piece according to claim 2 further comprising the steps of:

fitting and placing the metallic material part, which has been plunged into said concave portion of said second die through said second pressing, on a concave portion of a third die; and performing third pressing in such a way as to press and expand said metallic material part placed on the concave portion of said third die toward the concave portion of said third die and thereby form a circumferential wall portion having a predetermined height around a top portion.

4. A method of producing a terminal piece according to claim 2 wherein said circumferential wall portion is formed such that said top portion juts out of a resinous base member when performing insertion into said resinous base member by pressing the metallic material which has been Plunged into said concave portion.

5. A method of producing a terminal piece, said method comprising the steps of:

placing a plate-shaped metallic material upon a first die having a plate shape;

performing first pressing in such a way as to gather a peripheral part of said plate-shaped metallic material at a center of said plate-shaped metallic material by means of a first punch having a conically recessed pressing plane;

placing the metallic material which has undergone said first pressing upon a second die having a concave portion into which a gathered metallic material part is plunged; and performing second pressing in such a way as to pressing said gathered metallic material part toward said concave portion by means of a second punch, said concave portion being formed to be smaller in diameter than said second punch.

* * * * *